US011364515B2

(12) United States Patent
Utting

(10) Patent No.: US 11,364,515 B2
(45) Date of Patent: Jun. 21, 2022

(54) TRANSPORTABLE VEHICLE ENCLOSURES

(71) Applicant: David John Utting, Norwich (GB)

(72) Inventor: David John Utting, Norwich (GB)

( * ) Notice: Subject to any disclaimer, the term of this patent is extended or adjusted under 35 U.S.C. 154(b) by 144 days.

(21) Appl. No.: 15/637,713

(22) Filed: Jun. 29, 2017

(65) Prior Publication Data

US 2017/0297047 A1 Oct. 19, 2017

Related U.S. Application Data

(63) Continuation-in-part of application No. 14/417,523, filed as application No. PCT/GB2013/051999 on Jul. 25, 2013, now Pat. No. 9,724,720.

(30) Foreign Application Priority Data

Jul. 25, 2012 (GB) ..... 1213234
Oct. 31, 2012 (GB) ..... 1219589

(51) Int. Cl.

| | |
|---|---|
| ***B05B 16/80*** | (2018.01) |
| ***B05B 16/40*** | (2018.01) |
| ***B05B 15/40*** | (2018.01) |
| ***B05B 16/20*** | (2018.01) |
| ***B05B 16/60*** | (2018.01) |
| ***B05B 14/43*** | (2018.01) |

(52) U.S. Cl.

CPC ..... *B05B 16/40* (2018.02); *B05B 14/43* (2018.02); *B05B 15/40* (2018.02); *B05B 16/20* (2018.02); *B05B 16/60* (2018.02); *B05B 16/80* (2018.02)

(58) Field of Classification Search

None

See application file for complete search history.

(56) References Cited

U.S. PATENT DOCUMENTS

| | | | | |
|---|---|---|---|---|
| 1,734,660 A * | 11/1929 | Williams | E04C 2/425 52/669 |
| 2,841,684 A * | 7/1958 | Miskella | F26B 3/30 392/415 |
| 4,106,430 A | 8/1978 | Nakajima et al. | |
| 4,265,029 A | 5/1981 | Jenkins | |
| 4,562,791 A * | 1/1986 | Porter | B05B 14/45 118/326 |

(Continued)

FOREIGN PATENT DOCUMENTS

| | | |
|---|---|---|
| DE | 43 27 751 A1 | 2/1995 |
| DE | 20 2009 003 182 U1 | 6/2009 |

(Continued)

OTHER PUBLICATIONS

International Search Report and Written Opinion dated Oct. 17, 2013, issued in PCT Application No. PCT/GB2013/051999, filed Jul. 25, 2013.

*Primary Examiner* — Charles Capozzi
(74) *Attorney, Agent, or Firm* — Workman Nydegger

(57) ABSTRACT

A transportable vehicle enclosure for painting vehicles includes side, front, rear, ceiling and floor portions, one of the portions being configured to allow vehicular access. In use, a vehicle may be placed within the enclosure. The enclosure further includes an air handling unit for respectively producing a first temperature level within the enclosure suitable for a spray mode of operation and a second temperature level within the enclosure suitable for a baking mode of operation.

18 Claims, 4 Drawing Sheets

(56) References Cited

U.S. PATENT DOCUMENTS

| | | | | |
|---|---|---|---|---|
| 4,926,746 | A * | 5/1990 | Smith | B05B 16/60 454/51 |
| 5,113,600 | A | 5/1992 | Telchuk | |
| 5,853,215 | A | 12/1998 | Lowery | |
| 9,724,720 | B2 * | 8/2017 | Utting | F26B 25/066 |
| 2002/0119254 | A1 * | 8/2002 | DeRegge | B05B 16/60 118/500 |
| 2002/0139057 | A1 | 10/2002 | Ritzal | |
| 2005/0120948 | A1 | 6/2005 | DeRegge | |
| 2006/0107897 | A1 | 5/2006 | Cheng | |
| 2007/0056510 | A1 | 3/2007 | Antaya | |
| 2010/0101489 | A1 * | 4/2010 | Wurster | B05B 14/46 118/326 |
| 2010/0140277 | A1 | 6/2010 | Clive-Smith | |
| 2010/0272915 | A1 | 10/2010 | Laws | |
| 2011/0275300 | A1 * | 11/2011 | Nudleman | B05B 16/60 454/50 |

FOREIGN PATENT DOCUMENTS

| | | | |
|---|---|---|---|
| EP | 1 874 095 | A2 | 1/2008 |
| EP | 2 151 281 | A1 | 2/2010 |
| GB | 2 136 947 | A | 9/1984 |
| WO | 2005/118214 | A2 | 12/2005 |
| WO | 2014/016606 | A1 | 1/2014 |

* cited by examiner

TRANSPORTABLE VEHICLE ENCLOSURES

CROSS-REFERENCE TO RELATED APPLICATIONS

This application is a continuation-in-part of U.S. application Ser. No. 14/417,523, filed Jan. 26, 2015, which is a Nationalization of PCT Application No. PCT/GB2013/051999, filed Jul. 25, 2013, which claims priority to United Kingdom Application No. 1213234.6, filed Jul. 25, 2012 and United Kingdom Application No. 1219589.7, filed Oct. 31, 2012, which are incorporated herein by specific reference.

BACKGROUND OF THE INVENTION

1. The Field of the Invention

The invention relates to transportable vehicle enclosures suitable for painting vehicles.

2. The Relevant Technology

The following prior art documents are acknowledged: U.S. Pat. No. 5,853,215, WO2005/118214, US2010/0272915, US2005/0120948 and US2002/0139057. Each one of these prior art documents discloses a mobile or transportable vehicular/vehicle component workshop. None of these however appears to disclose an enclosure suitable for conducting automobile spray painting and curing operations in an effective stand-alone facility. For example, U.S. Pat. No. 5,853,215 is provided with an outside temperature dependent air inlet to the rear of the enclosure any heating is provided solely by the infrared heaters which are fixed to the ceiling. According to the description in column 6, the fan continuously purges the work station of this prior art embodiment. Curing is provided by the use of fixed infrared curing lights 64 provided in the ceiling of the enclosure. The air handling unit of this prior art embodiment therefore appears to be of a single mode of use kind. With regard to WO2005/118214, there appears to be no disclosure of an enclosure of the kind in question with an appropriate air handling unit. US2010/0272915 fails to disclose an enclosure of the kind in question it is an inflatable structure which would be wholly unsuitable for a baking mode of operation. Finally, US2002/0139057 is also silent with regard to an air handling unit of the kind in question.

SUMMARY OF THE INVENTION

In its broadest independent aspect, the invention provides a transportable vehicle enclosure for painting vehicles comprising side, front, rear, ceiling and floor portions, one of the portions being configured to allow vehicular access; whereby, in use, a vehicle may be placed within the enclosure; the enclosure further comprising an air handling unit for respectively producing a first temperature level within the enclosure suitable for a spray mode of operation and a second temperature level within the enclosure suitable for a baking mode of operation.

This configuration is particularly advantageous because it allows both spray painting and curing operations to be tackled in a stand-alone facility. The provision of the air handling unit may be particularly beneficial in certain embodiments where an optimum spraying temperature may be reached for the spraying mode of operation and in embodiments where a much higher temperature level may be applied within the enclosure for the curing mode of operation. This would allow the use of manufacturer compliant paint products to be employed.

The term vehicle (and the related adjective vehicular) is to be interpreted broadly and may include within its scope at least the following: automotive vehicles, vessels, sledges, cycles, planes, toys and parts and fittings of such devices.

In a subsidiary aspect, the enclosure is formed as a mono-block suitable for loading onto a transporter and unloading from a transporter, wherein the air handling unit is integral with the mono-block. This configuration is particularly advantageous as it allows the full painting and baking operation, producing first and second temperature levels suitable for each stage, to be carried out in a transportable mono-block in any detached isolated location and in any external temperature condition. It may be simply dropped off and picked up by a specialised transportation vehicle to provide a one-stop shop facility in a full range of environmental conditions. It also achieves this without unduly complicating the air handling unit which provides a compact structure ideal for transportation.

In a further subsidiary aspect, the air handling unit incorporates an upper air duct for outputting air into the enclosure at either the first or second temperature level; and a lower extraction duct located towards a rear portion of the enclosure's floor; whereby air flows substantially diagonally between the upper air duct and the lower extraction duct. This configuration is particularly advantageous in terms of presenting a particularly compact enclosure which may be easily transported, reloaded and unloaded in different locations. It also allows particularly voluminous under-vehicle extractors to be avoided. It therefore allows a particularly compact floor to be generated which is advantageous for transportation but also in use since the requirements for ramps can be kept to an absolute minimum (if not avoided in their entirety).

In a further subsidiary aspect, the rear portion incorporates an air handling unit and the lower extraction duct is located adjacent to the air handling unit in the floor. This configuration is particularly advantageous in terms of overall compactness of enclosure for improved transportability.

In a further subsidiary aspect, the air handling unit incorporates a heater; the heater being a direct-fired gas burner which is capable of heating air in both the spraying mode of operation and the baking mode of operation. This configuration is particularly advantageous in terms of rapidity of switching between modes of operation. It also offers a particularly advantageous environmental solution.

In a further subsidiary aspect, the air handling unit incorporates a heater; a fresh air inlet; and an airflow controller which in a first position allows fresh air to flow to said heater and which in a second position allows air to flow from inside the enclosure to the heater in order to re-circulate the air. This configuration is particularly advantageous in terms of reducing the heating required during the baking mode of operation.

In a further subsidiary aspect, the air flow controller is configured to automatically change from the first to the second position after a predetermined period of time elapses during which no spraying occurs. This is also particularly advantageous in reducing the consumption of the heater whilst avoiding having to rely on an operator's input.

In a further subsidiary aspect, the enclosure further comprises a spray gun with a compressed air line; an air flow sensor being provided to sense the flow of air in said compressed air line; the controller changes from the first position to the second position dependent upon the detected presence or absence of air flow. This configuration is particularly advantageous in terms of providing a mechanism directly linked to the spraying cycle to ensure a rapid and efficient switching between modes of operation.

In a further subsidiary aspect, the enclosure is triangular in plan view and its rear most side contains the air handling plant. This provides a particularly compact configuration.

In a further subsidiary aspect, less than ¾ of the rear side surface is occupied by the air handling plant. This is particularly beneficial in terms of reducing the size of the overall structure. It also allows the rear side to accommodate ancillary devices and/or equipment.

In a further subsidiary aspect, the floor is formed of longitudinal and sideways extending struts; said floor extraction duct being formed between sideways extending struts. This avoids the air handling unit being unduly elevated thus allowing the relatively complex multi-function air handling unit to fit comfortably between the unit's sides.

In a further subsidiary aspect, the floor extraction duct incorporates a lattice beam which may form a zig-zag pattern; whereby passageways are provided for extracting air. This configuration is particularly advantageous in order to allow the passage of air through sideways extending struts whilst at the same time providing sufficient structural rigidity to the enclosure.

In a further subsidiary aspect, the floor extraction duct incorporates an extraction filter. This is particularly advantageous in terms of minimising potential emissions from the enclosure.

In a further subsidiary aspect, the air emitted from the enclosure passes through a two or more stage filter. This multi-stage filtration process further advantageously reduces potential emissions from the enclosure.

In a further subsidiary aspect, the enclosure is formed as a single integral block or transportation. This would allow the enclosure to be transported relatively straightforwardly which would allow it to be temporarily placed on a site such as a car dealership. In preferred embodiments, it would avoid the use of mobile repair shops which are used in the open air where environmental emissions are uncontrolled. It would allow repairs ranging from a relatively small spot repair to a complete repaint of a car to be provided in any location where a need arises whilst maintaining a very high level of quality and preserving the environment.

In a further subsidiary aspect, the enclosure further comprises a dryer unit which is displaceable within the enclosure. This is particularly advantageous when applying heat to a specific location, or for example, small scale repairs.

In a further subsidiary aspect, the dryer unit is displaceable at least longitudinally within the enclosure and rotatably at least about an axis normal to the enclosure's floor. This allows the localised dryer unit to be positioned to take into account the specific site of the repair on the vehicle whilst at the same time potentially taking into account the curvature of the vehicle for optimum heat diffusion.

DETAILED DESCRIPTION OF THE PREFERRED EMBODIMENTS

Figure 1:
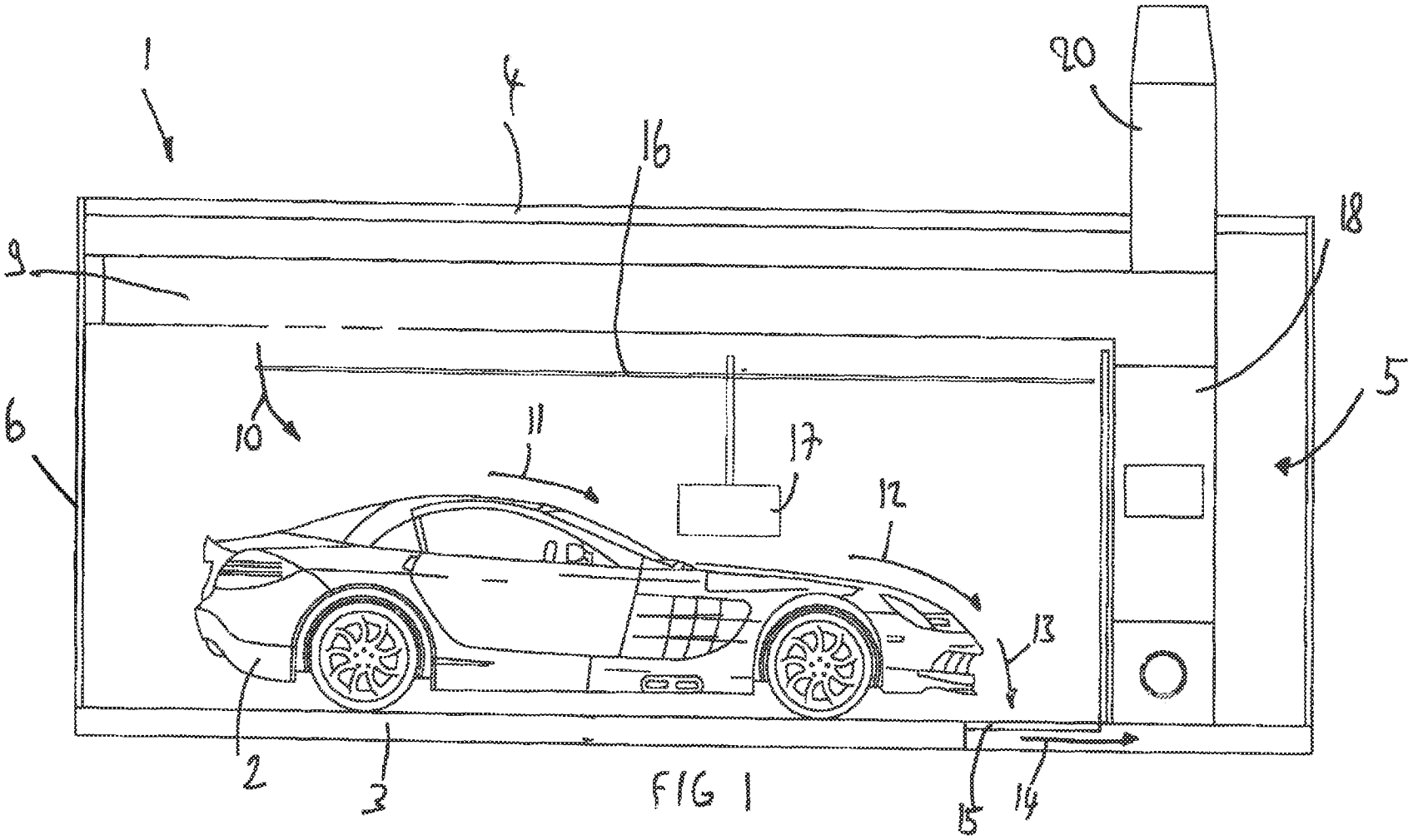
FIG. 1 shows a schematic cross-sectional view of a transportable vehicle enclosure.
Figure 2:
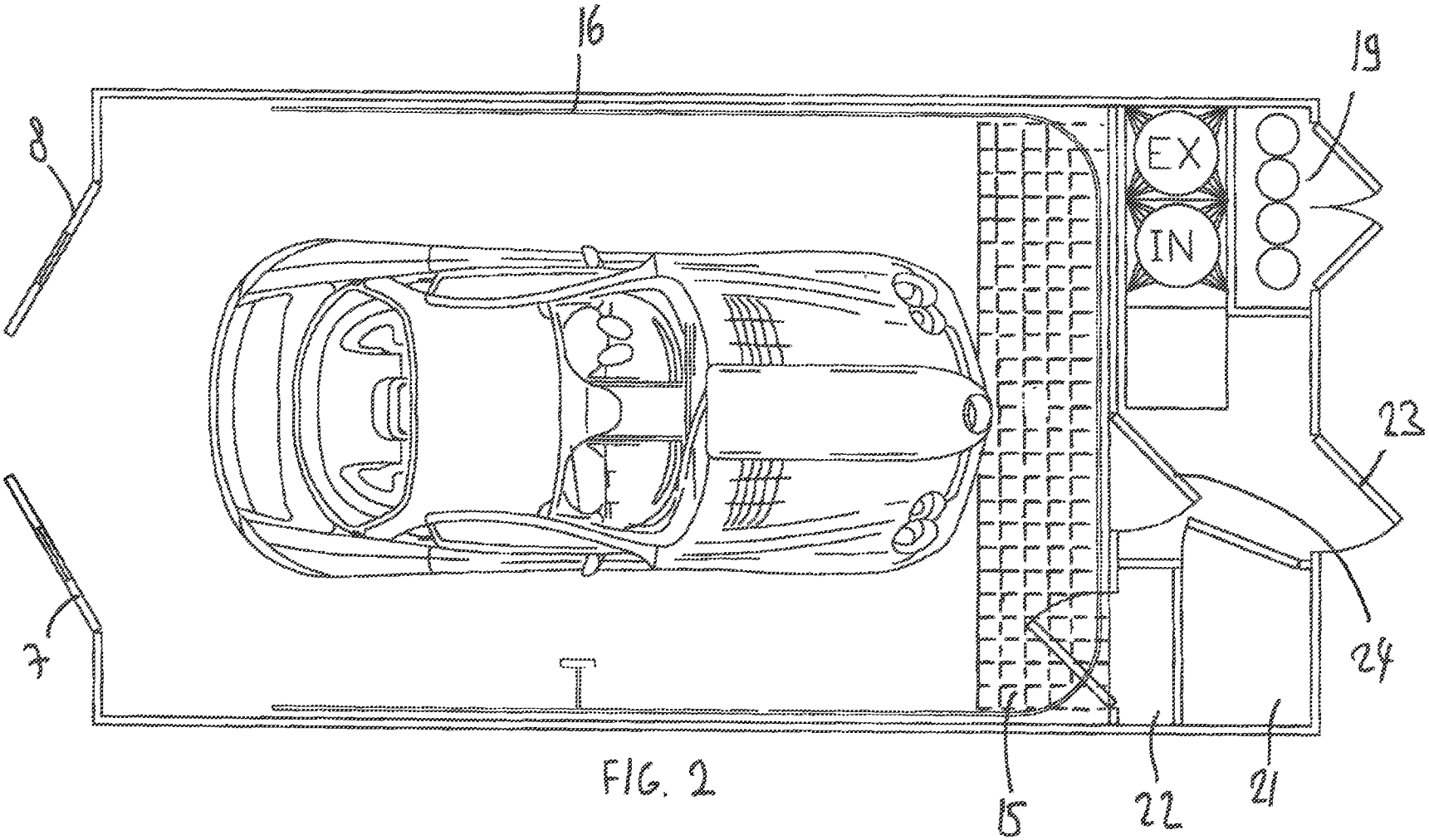
FIG. 2 shows a cross-sectional plan view of an enclosure.

FIG. 1 shows a transportable vehicle enclosure generally referenced 1 for painting vehicles such as vehicle 2. The enclosure incorporates a floor 3, a ceiling 4 and a rear portion 5. The enclosure may incorporate an explosion relief panel. Advantageously, the explosion relief panel may be incorporated into the ceiling of the enclosure. The front portion 6 incorporates doors 7 and 8 as shown in FIG. 2 which may be opened to permit the passage into and out of the enclosure by for example a motor vehicle. Treated air passes through inlet plenum 9 before reaching the vehicle containing portion of the enclosure. The air flows substantially diagonally across the length of the inside of the enclosure as illustrated by the series of arrows 10-14. The air exits at the vehicle containing area at the rearmost portion of the enclosure where a lower extraction duct 15 is integrated into the floor.

A track 16 extends along the side and rearmost portions of the inner surface of the enclosure. Track 16 may be used to secure an infrared dryer unit 17. The infrared dryer unit may displace along said track in order to allow the positioning of the dryer in close proximity to the particular area of the vehicle. Track 16 serves to displace the dryer unit longitudinally. However, in addition to this mode of displacement, in a preferred embodiment, the dryer unit may also be displaceable in a direction orthogonal to the floor. This would allow the dryer unit to be positioned at different heights in order to target different locations. In addition, the dryer unit may be configured to accommodate a degree of rotation about an axis normal to the floor. In a further embodiment, the dryer unit may also tilt forwards and backwards. These modes of displacement would allow localised drying to occur whilst taking into account disparate vehicle sizes and curvatures.

In the rear portion 5 of the enclosure, an air handling unit 18 may be provided. The air handling unit may incorporate a direct gas-fired burner with input and extraction fans. In a preferred embodiment, the input and extraction fans may be twin input and extraction fans with a power rating of 3-4 kW. Behind the gas handling plant, a bespoke gas storage area 19 is provided (as shown in FIG. 2) with a plurality of gas cylinders. Alternatively, instead of a bespoke gas storage area, gas bottles may simply be provided at substantially ground level outside of the enclosure. An extraction duct 20 is provided and may advantageously reduce emissions under 10 mg/m3 at a 15 meter per second velocity.

The lower extraction duct 15 may incorporate a gridded floor section with two stages of filtration beneath the section to ensure effective removal of particulate matter. The inlet plenum 9 may incorporate a TA600 high particle filter i.e. a 600 micro particle performance rated filter with a 6% potassium permanganate impregnated filter media suitable for removing airborne pollutants. The floor may be an integrated structural floor which will provide additional structural strength which would be particularly advantageous during relocation. In preferred embodiment, the entire air handling plant is provided above the ground. Preferably, only part of the floor incorporates vents. In a preferred embodiment, the floor is relatively shallow.

A paint store 21 may be provided in the rear portion. An equipment store 22 may also be provided in the rear portion. Door 23 may be provided to facilitate access to the rear portion from the outside whilst door 24 provides access from the inside of the enclosure to the rear portion.

Figure 3:
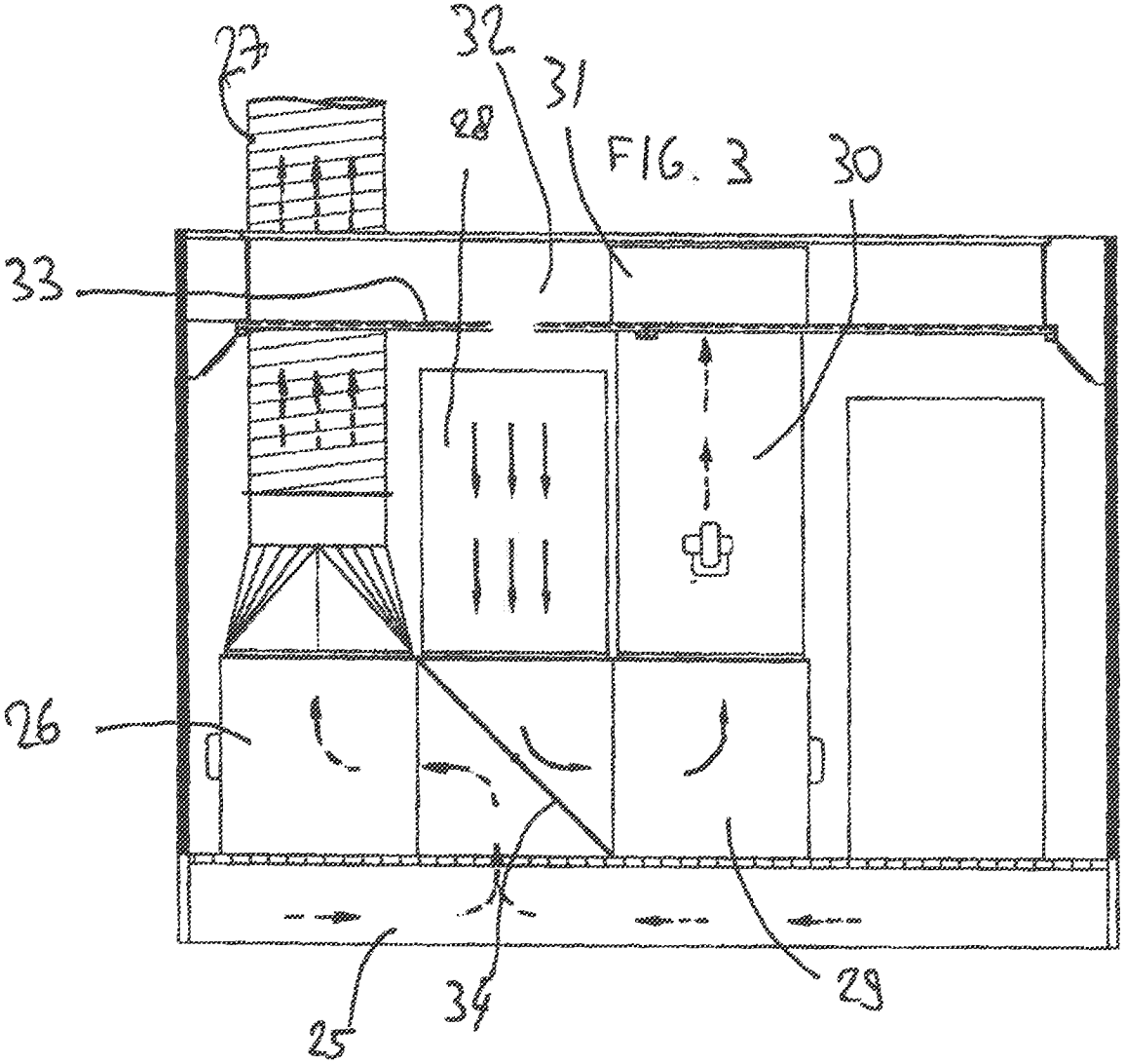
FIG. 3 shows a cross-sectional view across the rear portion of the enclosure with the flow paths of the air handling unit.

FIG. 3 shows an embodiment of the air handling unit in detail. The dashed arrows represent potential heated air circulating through the lower extraction duct 25 out. An extraction fan 26 applies suction in order to cause air to be drawn up and out the extraction duct 27. In the mode of operation shown in FIG. 3, the air handling unit is in the spray cycle mode of use during which enclosed air is filtered and extracted from the enclosure whilst fresh air is drawn through the inlet duct (which may be louvered in the rear wall) and to the burner for treatment. The inlet of air is driven by an inlet fan 29 which causes the flow of air through the direct fired gas burner 30 into the top plenum 31. An inlet plenum 32 is also provided together with an inlet filter 33. In the mode of use shown in FIG. 3 a two-way change-over flap box 34 is shown in a position where fresh air is drawn into the burner by the inlet/recirculation fan 29 whilst extracted air is drawn out of the enclosure via extractor fan 26.

Figure 4:
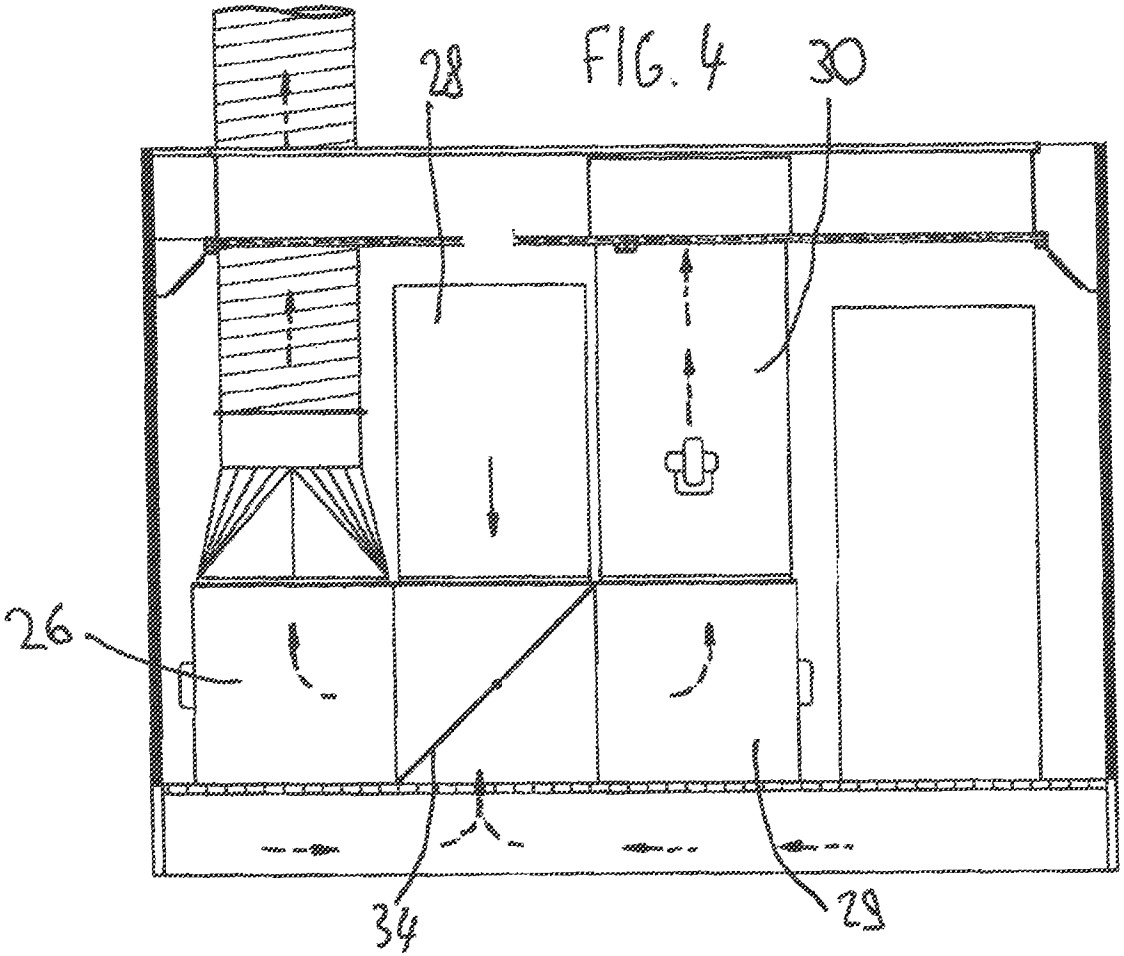
FIG. 4 shows the cross-sectional view of the kind shown in FIG. 3 with the flow of air in accordance with a further mode of operation.

FIG. 4 shows an alternative mode of use where the two-way change-over flap box 34 causes air originating from the enclosure to be re-circulated by the action of re-circulation fan 29. In this mode of operation, the gas burner 30 would potentially reheat the air obtained from the enclosure in order to eventually reach in the enclosure a temperature suitable for the baking mode of operation. In this mode of use, whilst the figure shows that the extraction fan 26 may draw air from the inlet, in practice the operation of the extraction fan would not take place or be considerably reduced.

FIGS. 3 and 4 are examples of the provision of a full heat facility both on a spray and a bake cycle which enables the drying of water based and two pack materials. In a preferred embodiment, the air handling plant may raise the temperature of the incoming air at a temperature which could be as low as −5° Celsius to 22° Celsius to enable a suitable spray temperature to be achieved. Similarly on the bake mode of operation, a temperature of 60° Celsius may be achieved over the entire vehicle contained in the enclosure to ensure complete curing of 2 pack materials.

In a preferred embodiment, the booth automatically changes from spray to recirculation once a period of no paint spraying has taken place for more than 4 minutes. This action may be controlled by a hot wire air flow sensor in the compressed air line to the spray gun with an input into the PLC and in turn controls the automatic standby mode, reducing the fan speed to 25% and thus reducing the gas consumption by 75%. Furthermore, the flap box changes to recirculation with the action of a pneumatic ram controlled by a solenoid. The flap box 34 may remain in recirculation mode until the painter applies further coats of paint or changes to bake cycle.

The systems incorporated into the enclosure save a significant amount of gas and therefore prolong the life of the gas bottles and reduce carbon emissions. Finally, the extracted air may be filtered via a two stage filter, reducing emissions below and potentially substantially below 10 mg per cubic meter of particle emissions to comply with stringent environmental requirements.

In summary, the vehicle enclosure may comprise a low bake oven for repairs and paintwork on cars. The enclosure may advantageously be built of a single mono block unit which may be easily transported, re-loaded and unloaded in a different location. When the enclosure is a mono-block it allows the full painting and baking operation to be carried out, producing first and second temperature levels suitable for each stage, in a transportable mono-block in any detached isolated location and in any external temperature condition.

Furthermore, in a preferred embodiment, it comprises its own direct gas-fired air handling unit with the spray and bake functions producing approximately 20° Celsius and 60° Celsius respectfully. It will also have a fully integrated paint mixing area, complete with self-contained gas storage, along with lockers for tools and equipment storage. In other words, in a preferred embodiment, the enclosure comprises a fully self-contained spray booth which may be conveniently transported across long distances as required. It may facilitate relatively small repairs to be made on the site of a car dealership rather than requiring transport to a multi-stage body shop.

In a further embodiment, the air handler incorporates an air cooling unit for reducing the temperature to the first temperature level in a further spraying mode of operation of the air handler. The air cooling unit may be an air conditioning unit. In further embodiments, it may be employed after a baking mode of operation in order to reduce the temperature rapidly prior to a spraying mode of operation. In further embodiments, the air cooling unit may be used before and during the spraying mode of operation to maintain the temperatures at an acceptable level for the spraying mode of operation. This would be of particular benefit when the enclosure is deployed in high ambient temperature environments.

The following further aspects are also worth noting:

- a fully transportable paint workstation for conducting automobile spray painting and curing operations in a stand-alone facility;
- a potentially fully integrated air handling system and emission control system;
- a fully integrated paint mixing room with paint storage options;
- a self-contained gas storage to enable the unit to be self-sufficient;
- a reduction in emissions;

due to the compactness of the enclosure and its overall integrated nature, it lends itself to rapid set-up in any appropriate site.

What is claimed is:

1. A transportable vehicle enclosure for painting vehicles, said enclosure comprising:

side, front, rear, ceiling, and floor portions, said side portions incorporating a first external side wall and a second external side wall, said second external side wall being located opposite said first external side wall, said rear portion incorporating an internal rear wall extended between said first and second external side walls; and a rear external wall extending between said first and second external side walls, said front portion being configured to allow vehicular access, and said front portion and rear external wall being located at opposite extremities of said enclosure;

whereby, in use, a vehicle may be placed within a vehicular portion of said enclosure on top of said floor portion which comprises struts extending longitudinally and sideways to form a hollow wheel-less floor for directly resting on a ground surface; a length of said external side walls being longer than a length of said rear external wall;

said enclosure further comprising a spray gun suitable for spraying during a spraying mode of operation;

an air handler incorporating a heater for respectively producing a first temperature level within said enclosure suitable for the spraying mode of operation and a second temperature level within said enclosure suitable for a baking mode of operation, wherein the enclosure is formed as a mono-block suitable for loading onto a transporter and unloading from a transporter, wherein said air handler is integral with said mono-block, said heater being located within a space defined by said first external side wall, said second external side wall, said rear external wall, said ceiling portion, said internal rear wall and said floor portion, whereby the production of said first and second temperature levels takes place within said space at the rear portion of said enclosure; and said ceiling portion comprises a plenum extending from said internal rear wall towards said front portion; whereby heated air is ducted from said rear portion of the enclosure towards said front portion.

2. The enclosure according to claim 1, wherein said air handler incorporates an upper air duct extending under said ceiling portion from said rear portion towards said front portion for outputting air into said vehicular portion of said enclosure at either a first or a second temperature level and incorporates a lower extraction duct located towards a rear portion of the enclosure's floor, whereby air flows substantially diagonally between said upper air duct and said lower extraction duct which incorporates a gridded floor section.

3. The enclosure according to claim 2, said lower extraction duct being formed between sideways extending struts.

4. The enclosure according to claim 2, wherein said lower extraction duct incorporates a beam which forms a zigzag pattern; whereby passageways are provided for extracted air.

5. The enclosure according to claim 2, wherein said lower extraction duct incorporates an extraction filter.

6. The enclosure according to claim 2, wherein an opening extends through the floor portion directly adjacent to the interior rear wall so as to communicate with said lower extraction duct.

7. The enclosure according to claim 2, wherein said rear portion of the enclosure incorporates said air handler and said lower extraction duct is located adjacent to said air handler in said floor.

8. The enclosure according to claim 7, wherein the lower extraction duct is formed within the floor so as to not project below the struts which rest on the ground surface during use.

9. The enclosure according to claim 1, wherein said heater is a direct fired gas burner which is capable of heating air in both said spraying mode of operation and said baking mode of operation.

10. The enclosure according to claim 1, wherein said air handler further comprises a fresh air inlet, at least one fan, and an airflow controller, which, in a first position, allows fresh air to flow to said heater and which, in a second position, allows air to flow inside said enclosure from said vehicular portion of said enclosure to said heater in order to re-circulate said air.

11. The enclosure according to claim 10, wherein said airflow controller is configured to automatically change from said first to said second position after a predetermined period of time elapses during which no spraying occurs.

12. The enclosure according to claim 11, further comprising a compressed air line with said spray gun; an air flow sensor being provided to sense the flow of air in said compressed air line; said controller changes from said first position to said second position dependent upon the detected presence or absence of air flow.

13. The enclosure according to claim 1, wherein less than ¾ of said rear portion is occupied by said air handler; said rear portion incorporates a door to access said rear portion from said vehicular portion and a further door to exit said rear portion.

14. The enclosure according to claim 1, further comprising an extraction duct extending through said ceiling portion, wherein air emitted from said enclosure passes through a two or more stage filter before exiting through said extraction duct.

15. The enclosure according to claim 1, further comprising a dryer and a track; said dryer being secured to said track and thereby being displaceable along said track within the enclosure.

16. The enclosure according to claim 15, wherein said dryer is displaced at least longitudinally within the enclosure and rotatably at least about an axis normal to the enclosure's floor.

17. The enclosure according to claim 1, wherein said air handler incorporates an air conditioner for reducing said temperature to said first temperature level in a further spraying mode of operation of said air handler.

18. A transportable vehicle enclosure for painting vehicles, said enclosure comprising:

side, front, rear, ceiling, and floor portions, said side portions incorporating a first external side wall and a second external side wall, said second external side wall being located opposite said first external side wall, said rear portion incorporating an internal rear wall extending between said first and second external side walls; and a rear external wall extending between said first and second external side walls; said front portion being configured to allow vehicular access, and said front portion and rear external wall being located at opposite extremities of said enclosure;

whereby, in use, a vehicle may be placed within a vehicular portion of said enclosure; on top of said floor portion which comprises struts extending longitudinally and sideways; the struts forming a hollow wheel-less floor for directly resting on a ground surface; a length of said external side walls being longer than a length of said rear external wall;

said enclosure further comprising a spray gun suitable for spraying during a spraying mode of operation;

an air handler incorporating an air conditioner for respectively producing a first temperature level within said enclosure suitable for the spraying mode of operation and a second temperature level within said enclosure suitable for a baking mode of operation, wherein the enclosure is formed as a mono-block suitable for loading onto a transporter and unloading from a transporter, wherein said air handler is integral with said mono-block; said air handler incorporating a heater being located within a space defined by said first external side wall, said second external side wall, said rear external wall, said ceiling portion, said internal rear wall and said floor portion, whereby the production of said first and second temperature levels takes place within said space at the rear portion of said enclosure.

* * * * *